US010048608B2

(12) United States Patent
Takemori

(10) Patent No.: US 10,048,608 B2
(45) Date of Patent: Aug. 14, 2018

(54) TONER

(71) Applicant: KYOCERA Document Solutions Inc., Osaka (JP)

(72) Inventor: Toshiki Takemori, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 15/806,409

(22) Filed: Nov. 8, 2017

(65) Prior Publication Data

US 2018/0143549 A1 May 24, 2018

(30) Foreign Application Priority Data

Nov. 18, 2016 (JP) ..... 2016-225159

(51) Int. Cl.
*G03G 9/093* (2006.01)
*G03G 9/08* (2006.01)
*G03G 9/087* (2006.01)

(52) U.S. Cl.
CPC ..... *G03G 9/09328* (2013.01); *G03G 9/0819* (2013.01); *G03G 9/0825* (2013.01); *G03G 9/08768* (2013.01); *G03G 9/09392* (2013.01)

(58) Field of Classification Search
None
See application file for complete search history.

(56) References Cited

U.S. PATENT DOCUMENTS 8,877,414 B2 * 11/2014 Sugawara ..... G03G 9/0819 430/108.1
2018/0024454 A1 * 1/2018 Ojima ..... G03G 9/09321 430/108.1

FOREIGN PATENT DOCUMENTS

JP H08-022142 A 1/1996

* cited by examiner

*Primary Examiner* — Janis L Dote
(74) *Attorney, Agent, or Firm* — Studebaker & Brackett PC

(57) ABSTRACT

Toner particles each have a toner core, a shell layer covering a surface of the toner core, and first resin particles containing a melamine resin. A shell layer coverage is 60% to 80%. The first resin particles each have an embedded portion and a protrusion portion. The embedded portions are embedded beneath the surface of the toner core. The protrusion portions protrude outward from the surface of the toner core in a radial direction of the toner particle. An average value Wd of thicknesses b of the shell layers, a number average value Dp of embedment depths c of the first resin particles, and a number average value Pd of primary particle diameters d of the first resin particles satisfy relations (1) to (3) shown below.

$$0.2 \leq Dp/Pd \leq 0.8 \quad (1)$$

$$(Pd-Dp) > Wd \quad (2)$$

$$0.10\ \mu m \leq Pd \leq 1.00\ \mu m \quad (3)$$

8 Claims, 3 Drawing Sheets

TONER

INCORPORATION BY REFERENCE

The present application claims priority under 35 U.S.C. § 119 to Japanese Patent Application No. 2016-225159, filed on Nov. 18, 2016. The contents of this application are incorporated herein by reference in their entirety.

BACKGROUND

The present disclosure relates to a toner.

In one example, toner particles each include a toner mother particle and an external additive adhering to a surface of the toner mother particle. The external additive for example includes external additive particles containing a melamine resin as a main component (hereinafter, referred to as "external additive melamine particles").

A known effect of the use of the external additive melamine particles is as follows. In a situation in which a toner including the external additive melamine particles is used to perform image formation, the external additive melamine particles detach from the toner mother particles and alone adhere to a surface of a photosensitive drum. The external additive melamine particles adhering to the surface of the photosensitive drum are not transferred to a transfer member in a transfer process and are supplied to a cleaning member to adhere to a cleaning blade. The external additive melamine particles adhering to the cleaning blade can reduce frictional resistance between the photosensitive drum and the cleaning blade. Accordingly, it is possible to remove foreign substances adhering to the surface of the photosensitive drum without imposing unnecessary scratches to the surface of the photosensitive drum.

SUMMARY

A toner according to the present disclosure is positively chargeable and includes a plurality of toner particles. Each of the toner particles has a toner core, a shell layer covering a surface of the toner core, and a plurality of first resin particles containing a melamine resin. A proportion of an area of a region, of a surface of the toner core, that is covered with the shell layer is at least 60% and no greater than 80%. Each of the first resin particles has an embedded portion and a protrusion portion. The embedded portions are embedded beneath the surface of the toner core. The protrusion portions protrude outward from the surface of the toner core in a radial direction of the toner particle. An average value Wd of thicknesses b of the shell layers, a number average value Dp of embedment depths c of the first resin particles, and a number average value Pd of primary particle diameters d of the first resin particles satisfy relations (1) to (3) shown below.

$$0.2 \leq Dp/Pd \leq 0.8 \quad (1)$$

$$(Pd-Dp) > Wd \quad (2)$$

$$0.10\ \mu m \leq Pd \leq 1.00\ \mu m \quad (3)$$

In relation (1), the number average value Dp of the embedment depths c of the first resin particles refers to a number average value of lengths of the embedded portions in the radial direction of the toner particle.

DETAILED DESCRIPTION

Figure 1:
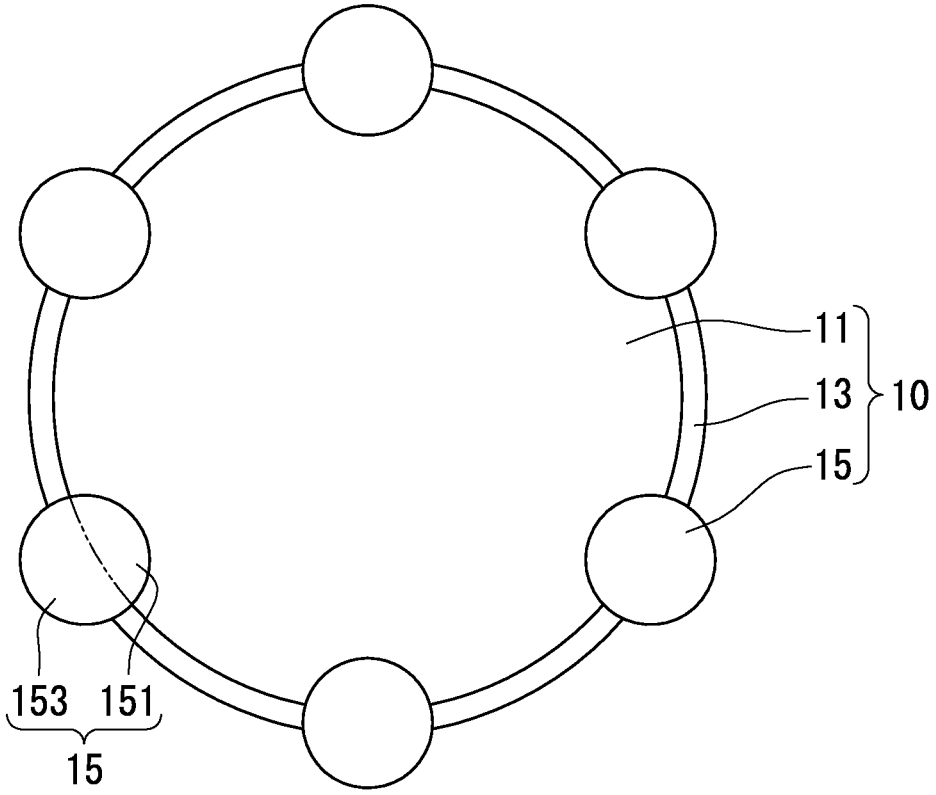
FIG. 1 is a cross-sectional view illustrating an example of toner particles included in a toner according to the present disclosure.

The following describes an embodiment of the present disclosure. Note that unless otherwise stated, results (values indicating shapes or properties) of evaluations that are performed on toner cores, toner particles, toner mother particles, or an external additive are number averages of measurements made with respect to an appropriate number of particles. The term "toner mother particles" refers to toner particles having no external additive. The term "external additive" refers to a powder including a plurality of external additive particles. The term "external additive particles" refers to particles that adhere to surfaces of the toner mother particles by electrostatic interaction. More specifically, the term "external additive particles" refers to particles that adhere to surfaces of shell layers by electrostatic interaction.

A number average particle diameter of a powder is a number average of equivalent circle diameters of primary particles (diameters of circles having the same area as projections of the particles) measured using a microscope, unless otherwise stated. A value for volume median diameter ($D_{50}$) of a powder is measured based on the Coulter principle (electrical sensing zone technique) using "Coulter Counter Multisizer 3", product of Beckman Coulter, Inc., unless otherwise stated.

Acid values and hydroxyl values are measured in accordance with "Japanese Industrial Standard (JIS) K0070-1992", unless otherwise stated. Values for number average molecular weight (Mn) and mass average molecular weight (Mw) are measured by gel permeation chromatography, unless otherwise stated. A value for a glass transition point (Tg) is measured using a differential scanning calorimeter ("DSC-6220", product of Seiko Instruments Inc.), unless otherwise stated. A value for a softening point (Tm) is measured using a capillary rheometer ("CFT-500D", product of Shimadzu Corporation), unless otherwise stated.

The term "-based" may be appended to the name of a chemical compound in order to form a generic name encompassing both the chemical compound itself and derivatives thereof. When the term "-based" is appended to the name of a chemical compound used in the name of a polymer, the term indicates that a repeating unit of the polymer originates from the chemical compound or a derivative thereof. The term "(meth)acryl" may be used as a generic term for both acryl and methacryl.

Toner According to Present Embodiment

The toner according to the present embodiment is a positively chargeable toner including a plurality of toner particles. Each of the toner particles has a toner core, a shell layer covering a surface of the toner core, and a plurality of first resin particles containing a melamine resin. The proportion of the area of a region, of the surface of the toner core, that is covered with the shell layer is at least 60% and no greater than 80%. Each of the first resin particles has an embedded portion and a protrusion portion. The embedded portions are embedded beneath the surface of the toner core. The protrusion portions protrude outward from the surface of the toner core in a radial direction of the toner particle. An average value Wd of shell layer thicknesses b, a number average value Dp of embedment depths c of the first resin particles, and a number average value Pd of primary particle diameters d of the first resin particles satisfy relations (1) to (3) shown below.

$$0.2 \leq Dp/Pd \leq 0.8 \quad (1)$$

$$(Pd-Dp) > Wd \quad (2)$$

$$0.10\ \mu m \leq Pd \leq 1.00\ \mu m \quad (3)$$

Hereinafter, the number average value Dp of the embedment depths c of the first resin particles in relation (1) refers to a number average value of the lengths of the embedded portions in the radial direction of the toner particle.

The following first describes, in order, the proportion of the area of a region, of the surface of the toner core, that is covered with the shell layer (also referred to below as "a shell layer coverage", the number average value Dp of the embedment depths c of the first resin particles, the average value Wd of the shell layer thicknesses b, and the number average value Pd of the primary particle diameters d of the first resin particles. Next, the toner according to the present embodiment will be described in detail with reference to the accompanying drawings.

Explanations of Terms

The shell layer coverage is measured in accordance with a method described below. First, toner particles are dyed in ruthenium (Ru). In a situation in which the toner particles have an external additive, the toner particles are preferably dyed in Ru after removing the external additive from the surfaces of the shell layers. Next, one of the dyed toner particles is observed using a field effect scanning electron microscope (FE-SEM) (for example, "JSM-7600F", product of JEOL Ltd.) at a magnification of for example ×50,000. Thus, a backscattered electron image of the toner particle is obtained. It should be noted here that the shell layers are dyed in Ru more easily than the toner cores. Accordingly, in the backscattered electron image of the toner particle, the shell layer appears brighter than the toner core. Next, the backscattered electron image of the toner particle is analyzed using image analysis software (for example, "WinROOF", product of Mitani Corporation). Next, an area $S_{A1}$ of the entire backscattered electron image of the toner particle and an area $S_{B1}$ of a brighter region of the backscattered electron image are determined, and the shell layer coverage is calculated in accordance with the following formula.

$$\text{Shell layer coverage} = 100 \times \text{Area } S_{B1} / \text{Area } S_{A1}$$

The number average value Dp of the embedment depths c of the first resin particles is measured in accordance with a method described below. First, a TEM photograph of cross-sections of toner particles is captured. In a situation in which the toner particles have an external additive, the TEM photograph of the cross-sections of the toner particles is preferably taken after removing the external additive from the surfaces of the shell layers. Next, the TEM photograph of the cross-sections of the toner particles is analyzed using image analysis software (for example, "WinROOF", product of Mitani Corporation). More specifically, a line length measurement function as a manual measurement function of a measurement tool is selected in the image analysis software. With the line length measurement function as the manual measurement function selected, several first resin particles (first resin particles that are each partially embedded in the surface of a toner core) are randomly selected in the TEM photograph of the cross-sections of the toner particles. The embedment depths of the respective first resin particles selected are measured, and a number average value thereof is calculated. Thus, the number average value Dp of the embedment depths c of the first resin particles is determined.

The shell layer thickness b refers to a dimension of a shell layer in the radial direction of the toner particle. The average value Wd of the shell layer thicknesses b is measured in accordance with a method described below. First, TEM photographs of cross-sections of toner particles are captured. In a situation in which the toner particles have an external additive, the TEM photographs of the cross-sections of the toner particles are preferably taken after removing the external additive from the surfaces of the shell layers. Next, the TEM photographs of the cross-sections of the toner particles are analyzed using image analysis software (for example, "WinROOF", product of Mitani Corporation). More specifically, on the cross-section of a toner particle, two straight lines are drawn to intersect at right angles at substantially the center of the cross-section. On the two respective straight lines, lengths (four lengths) that are each from an interface between the toner core and the shell layer (equivalent to the surface of the toner core) to the surface of the shell layer are measured. An average value of the thus measured four lengths is taken to be the shell layer thickness of the toner particle. Such shell layer thickness measurement is performed for a plurality of toner particles to obtain an average value of shell layer thicknesses for the toner particles (measurement targets). Thus, the average value Wd of the shell layer thicknesses b is determined.

In a situation in which a boundary between a toner core and a shell layer is unclear in the TEM photograph of the cross-section of a toner particle, the TEM photograph of the cross-section of the toner particle is preferably analyzed using an electron energy loss spectrometer (EELS) (for example, "GIF TRIDIEM (registered Japanese trademark)", product of Gatan, Inc.) and image analysis software (for example, "WinROOF", product of Mitani Corporation). The use of an electron energy loss spectrometer and image analysis software makes the boundary between the toner core and the shell layer clear in the TEM photograph of the cross-section of the toner particle, enabling determination of the average value Wd of the shell layer thicknesses b.

The number average value Pd of the primary particle diameters d of the first resin particles refers to a number average value of equivalent circle diameters of primary particles (primary particles of the first resin particles) measured by observing surfaces of toner particles using a microscope (for example, a scanning electron microscope). In a situation in which the toner particles have an external additive, the surfaces of the toner particles are preferably observed after removing the external additive from the surfaces of the shell layers.

First Example of Toner According to Present Embodiment

Figure 2:
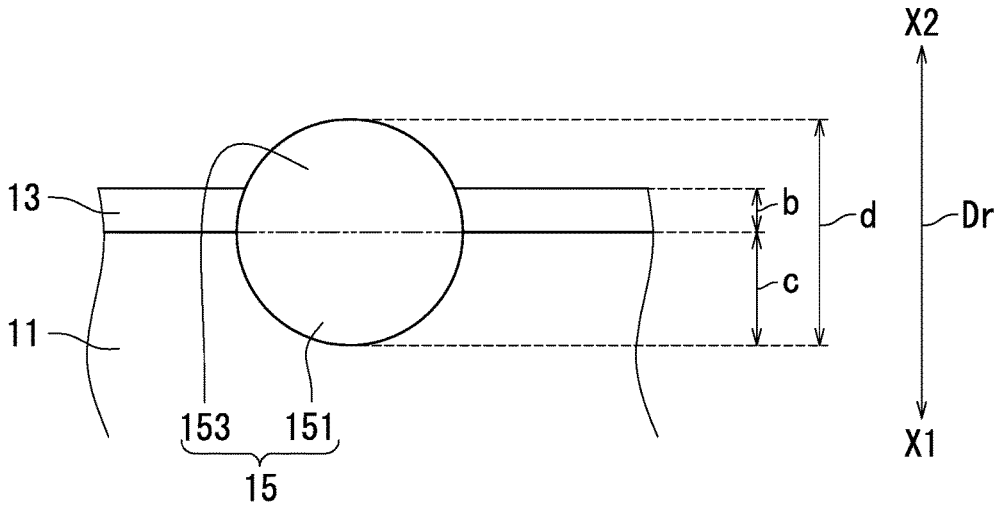
FIG. 2 is a diagram for illustrating a shell layer thickness b, an embedment depth c of a first resin particle, and a primary particle diameter d of the first resin particle.

The following describes an example of the toner particles included in the toner according to the present embodiment with reference to FIGS. 1 and 2. FIG. 1 is a cross-sectional view illustrating an example of toner particles included in the toner according to the present embodiment. FIG. 2 is a diagram for illustrating the shell layer thickness b, the embedment depth c of each first resin particle, and the primary particle diameter d of the first resin particle. Although a surface of a toner core 11 and a surface of a shell layer 13 are depicted using straight lines in FIG. 2, the surface of the toner core and the surface of the shell layer in an actual toner particle have spherical shapes (circular cross-sections).

The toner including a plurality of toner particles 10 illustrated in FIG. 1 is an electrostatic latent image developing toner suitably usable for developing an electrostatic latent image, and is for example used for image formation in an electrophotographic apparatus. In the image formation using the toner including the toner particles 10, a charger first uniformly charges a photosensitive layer of a photosensitive drum. Next, a light exposure device forms an electrostatic latent image on the photosensitive layer of the photosensitive drum based on image data. Next, a developing device develops the electrostatic latent image on the photosensitive layer of the photosensitive drum using the toner carried on a magnetic roller. Through the above, a toner image is formed on the photosensitive layer of the photosensitive drum. Next, the toner image is transferred onto a recording medium (more specifically, printing paper). Thereafter, the fixing device fixes the toner particles in the toner image to the recording medium. The toner including the toner particles 10 may be used as a one-component developer or may be mixed with a carrier to be used as a two-component developer. Preferably, the toner including the toner particles 10 is positively chargeable.

Each of the toner particles 10 has the toner core 11, the shell layer 13 covering the surface of the toner core 11, and a plurality of first resin particles 15 containing a melamine resin. The proportion of the area of a region, of the surface of the toner core 11, that is covered with the shell layer 13 is at least 60% and no greater than 80%. Each of the first resin particles 15 has an embedded portion 151 and a protrusion portion 153. The embedded portions 151 are embedded beneath the surface of the toner core 11. The protrusion portions 153 protrude from the surface of the toner core 11 toward a radially outer side X2 (see FIG. 2) of the toner particle 10. The average value Wd of the thicknesses b of the shell layers 13, the number average value Dp of the embedment depths c of the first resin particles 15, and the number average value Pd of the primary particle diameters d of the first resin particles 15 satisfy relations (1) to (3) shown below.

$$0.2 \leq Dp/Pd \leq 0.8 \quad (1)$$

$$(Pd-Dp) > Wd \quad (2)$$

$$0.10\ \mu m \leq Pd \leq 1.00\ \mu m \quad (3)$$

The term "radially outer side X2 of the toner particle 10" refers to an end that is one of opposite ends of the radius of the toner particle 10 and that is located at the outer side X2 in a radial direction of the toner particle 10. The term "radially inner side X1 of the toner particle 10", which is mentioned below, refers to an end that is the other of the opposite ends of the radius of the toner particle 10 and that is located at the inner side X1 (see FIG. 2) in the radial direction of the toner particle 10.

The number average value Dp of the embedment depths c of the first resin particles 15 in relation (1) refers to a number average value of the lengths of the embedded portions 151 in the radial direction Dr of the toner particle 10.

The "Dp/Pd" in relation (1) refers to a number average value of proportions of the embedded portions 151 out of the respective first resin particles 15. In the present embodiment, "relation (1) being satisfied" means the same as "each of the first resin particles 15 having the embedded portion 151". Preferably, the number average value Dp of the embedment depths c of the first resin particles 15 and the number average value Pd of the primary particle diameters d of the first resin particles 15 are determined in accordance with the methods described above (Explanations of Terms) and used to calculate the "Dp/Pd".

The "(Pd−Dp)" in relation (2) refers to a number average value of the lengths of the protrusion portions 153 in the radial direction Dr of the toner particle 10. The protrusion portions 153 refer to portions of the respective first resin particles 15 that are not the embedded portions 151. The "Wd" in relation (2) refers to an average value of the thicknesses b of the shell layers 13. Accordingly, "relation (2) being satisfied" means the same as the protrusion portions 153 being uncovered by the shell layer 13 in portions thereof at the radially outer side X2 of the toner particle 10. Preferably, the number average value Dp of the embedment depths c of the first resin particles 15 and the number average value Pd of the primary particle diameters d of the first resin particles 15 are determined in accordance with the methods described above (Explanations of Terms) and used to calculate the "(Pd−Dp)".

As a result of the toner particles 10 having the above-described feature, the toner including the toner particles 10 is excellent in charge stability, non-adhering properties, and low-temperature fixability.

More specifically, the toner particles 10 satisfy 0.2≤Dp/Pd (see relation (1)). As a result, the first resin particles 15 can be prevented from detaching from the surfaces of the toner cores 11 during for example image formation. Furthermore, the toner particles 10 have the shell layers 13 each covering the surface of a corresponding one of the toner cores 11 and satisfy relation (2). As a result, each of the protrusion portions 153 is easily covered with the shell layer 13 in a portion thereof at the radially inner side X1 of the toner particle 10. Thus, the shell layer 13 easily holds each of the first resin particles 15. Also for the reason given above, the first resin particles 15 can be prevented from detaching from the surfaces of the toner cores 11 during for example image formation. As described above, in image formation using the toner including the toner particles 10, the first resin particles 15 can be prevented from detaching from the surfaces of the toner cores 11 even in the case of continuous printing.

The first resin particles 15 contain a melamine resin, and the melamine resin is positively chargeable. Therefore, so long as the first resin particles 15 can be prevented from detaching from the surfaces of the toner cores 11 even in the case of continuous printing, it is possible to perform continuous printing without causing a reduction in the charge of the toner. Furthermore, so long as the first resin particles 15 can be prevented from detaching from the surfaces of the toner cores 11 even in the case of continuous printing, it is possible to prevent triboelectric charging from occurring between the toner particles 10 and the first resin particles 15 detached from the surfaces of the toner cores 11. Thus, the toner particles 10 can be prevented from being negatively charged. That is, the toner particles 10 can be prevented from oppositely charged.

Furthermore, the toner particles 10 satisfy Dp/Pd≤0.8 (see relation (1)). Accordingly, the first resin particles 15 are present in and around the surfaces of the toner particles 10. Accordingly, the toner including the toner particles 10 is positively charged easily.

As described above, the use of the toner including the toner particles 10 in image formation provides the effects of preventing the charge of the toner from being reduced, preventing the toner from being oppositely charged, and positively charging the toner in an efficient manner even in the case of continuous printing. Consequently, the toner including the toner particles 10 is excellent in charge stability.

Since the toner including the toner particles 10 is excellent in charge stability, the toner can be prevented from being excessively charged to positive polarity even in the case of continuous printing under a low-humidity environment, for example. Thus, developing properties of the toner can be kept adequate. Furthermore, since the toner including the toner particles 10 is excellent in charge stability, the charge of the toner can be prevented from being reduced even in the case of continuous printing under a high-humidity environment, for example. Thus, occurrence of fogging can be prevented.

The toner particles 10 satisfy $Pd \leq 1.00$ μm (see relation (3)). As a result, portions of the respective first resin particles 15 are easily embedded in the surfaces of the toner cores 11. As a result, $0.2 \leq Dp/Pd$ (see relation (1)) is easily satisfied. The toner particles 10 satisfy $0.10\ \mu m \leq Pd$ (see relation (3)). As a result, the first resin particles 15 can be prevented from being entirely embedded in the toner cores 11. As a result, $Dp/Pd \leq 0.8$ (see relation (1)) is easily satisfied.

Furthermore, the toner particles 10 have a coverage by the shell layers 13 of at least 60%. As a result, the toner including the toner particles 10 is excellent in non-adhering properties as well as in charge stability. It is therefore possible to prevent the toner from being left adhering to a surface of a component (for example, a surface of a photosensitive drum) of an image forming apparatus. As a result, occurrence of spots and image void in a resultant image can be prevented. Thus, an image of good quality can be formed by using the toner according to the present embodiment. In a situation in which the toner including the toner particles 10 is included in a two-component developer, the toner can be prevented from adhering to the surface of the carrier since the toner is excellent in non-adhering properties. As a result, triboelectric charging between the toner and the carrier is caused effectively, preventing the charge of the toner from being reduced. Thus, a two-component developer can be provided in which the toner is excellent in charge stability.

Furthermore, the toner particles 10 have a coverage by the shell layers 13 of no greater than 80%. It should be noted here that the shell layers 13 are more resistant to heat than the toner cores 11. However, it is thought that the toner (more specifically, the toner cores 11) readily melts during toner fixing as a result of the coverage by the shell layers 13 being no greater than 80%. Accordingly, the toner can be fixed at low temperatures. For the reason given above, the toner including the toner particles 10 is excellent in low-temperature fixability as well as in charge stability and non-adhering properties.

The following further describes relation (2). Considering relation (3), $(Pd-Dp)$ in relation (2) preferably satisfies $0.020\ \mu m \leq (Pd-Dp) \leq 0.120\ \mu m$. As a result of $0.020\ \mu m \leq (Pd-Dp)$ being satisfied, it is possible to easily achieve a coverage by the shell layers 13 of no greater than 80%, and thus it is possible to provide a toner having further improved low-temperature fixability. As a result of $(Pd-Dp) \leq 0.120\ \mu m$ being satisfied, it is possible to provide a toner having further improved non-adhering properties.

The melamine resin has relatively strong positive chargeability. Accordingly, the toner can be positively charged in an efficient manner so long as the first resin particles 15 are present in and around the surfaces of the toner particles 10. However, as mentioned above, the external additive melamine particles easily detach from the surfaces of the toner mother particles. The detachment of the external additive melamine particles tends to cause a reduction in the charge of the toner. The detachment of the external additive melamine particles may also cause the toner to be oppositely charged. To deal with the problem, the inventor at first thought of preventing detachment of the first resin particles from the surfaces of the toner cores by entirely covering the first resin particles present in the surfaces of the toner cores with the shell layers.

However, the shell layers tend not to melt or soften at low temperatures as being more resistant to heat than the toner cores. In the case of a toner in which the first resin particles present in the surfaces of the toner cores are entirely covered with the shell layers, therefore, it was difficult to cause the toner (more specifically, the toner cores) to melt or soften at a low temperature (see Comparative Example 3 described below). By entirely covering the first resin particles present in the surfaces of the toner cores with the shell layers, it was possible to merely provide a toner that is excellent in charge stability and non-adhering properties, and it was difficult to provide a toner that is excellent in low-temperature fixability as well as in charge stability and non-adhering properties (see Comparative Example 3 described below).

The toner including the toner particles 10 satisfies relations (1) to (3) and has a coverage by the shell layers 13 of at least 60% and no greater than 80%. As a result, the toner including the toner particles 10 is excellent in charge stability, non-adhering properties, and low-temperature fixability. The following describes a preferable structure of the toner particles 10.

Preferably, each of the shell layers 13 covers the surface of the corresponding toner core 11 such that the shell layer 13 covers a region surrounding the first resin particles 15. As a result, each of the protrusion portions 153 is more easily covered with the shell layer 13 in a portion thereof at the radially inner side X1 of the toner particle 10. Thus, the shell layer 13 holds each of the first resin particles 15 more easily. Thus, the first resin particles 15 can be prevented from detaching from the surfaces of the toner cores 11 more effectively during for example image formation. As a result, the first resin particles 15 can be prevented from detaching from the surfaces of the toner cores 11 more effectively even in the case of continuous printing. It is therefore possible to provide a toner having further improved charge stability.

More preferably, the shell layers 13 contain a melamine resin. That is, the resin contained in the shell layers 13 is the same as the resin contained in the first resin particles 15. As a result, in a configuration in which each of the protrusion portions 153 is covered with the shell layer 13 in a portion thereof at the radially inner side X1 of the toner particle 10, it is possible to increase affinity between each of the first resin particles 15 and the shell layer 13. The shell layer 13 therefore holds each of the first resin particles 15 more easily. Thus, the first resin particles 15 can be prevented from detaching from the surfaces of the toner cores 11 still more effectively during for example image formation. As a result, the first resin particles 15 can be prevented from detaching from the surfaces of the toner cores 11 still more effectively even in the case of continuous printing. As described above, in a situation in which the shell layers 13 contain a melamine resin, it is possible to provide a toner having further improved charge stability.

Furthermore, in a situation in which the shell layers 13 contain a melamine resin, the toner including the toner particles 10 is positively charged more easily.

Preferably, the toner (the toner including a plurality of the toner particles 10 illustrated in FIG. 1) has a fusing temperature as measured using a capillary rheometer (also referred to below simply as "a fusing temperature of the toner") of at least 80° C. and no greater than 110° C. Thus, the toner can for example be fixed at a temperature of at least 130° C. and no greater than 150° C. That is, the toner having a fusing temperature of at least 80° C. and no greater than 110° C. has further improved low-temperature fixability. The fusing temperature of the toner is measured in accordance with a method described below for Examples or a method conforming therewith.

The shell layers 13 are more resistant to heat than the toner cores 11. Accordingly, the fusing temperature of the toner tends to increase with an increase in the average value Wd of the thicknesses b of the shell layers 13, and the fusing temperature of the toner tends to decrease with a decrease in the average value Wd of the thicknesses b of the shell layers 13. The fusing temperature of the toner tends to increase with an increase in the coverage by the shell layers 13, and the fusing temperature of the toner tends to decrease with a decrease in the coverage by the shell layers 13.

The fusing temperature of the toner tends to increase with an increase in the softening point (Tm) of a resin component contained in the toner cores 11, and the fusing temperature of the toner tends to decrease with a decrease in the softening point of the resin component contained in the toner cores 11. Examples of resin components that can be contained in the toner cores 11 include a binder resin and wax. However, the main component of the toner cores 11 is a binder resin, and therefore the fusing temperature of the toner is readily controlled by controlling the softening point of the binder resin rather than the softening point of the wax.

Preferably, the average value Wd of the thicknesses b of the shell layers 13 is at least 10 nm and no greater than 50 nm. As a result of the average value Wd of the thicknesses b of the shell layers 13 being at least 10 nm, the resin component included in the toner cores 11 can be prevented from melting at times other than when the toner is fixed. Examples of resin components that can be contained in the toner cores 11 include a binder resin and wax. As a result of the average value Wd of the thicknesses b of the shell layers 13 being no greater than 50 nm, the resin component contained in the shell layers 13 melts during toner fixing, and therefore the toner particles 10 are readily fixed. As described above, the toner in which the average value Wd of the thicknesses b of the shell layers 13 is at least 10 nm and no greater than 50 nm can have further improved low-temperature fixability.

Preferably, the number average value Pd of the primary particle diameters d of the first resin particles 15 is at least 0.20 μm and no greater than 1.00 μm. As a result, the toner can have further improved charge stability, heat resistance, and low-temperature fixability.

Preferably, the first resin particles 15 are contained in an amount of at least 0.10 parts by mass and no greater than 1.50 parts by mass relative to 100 parts by mass of the toner cores 11. As a result of the first resin particles 15 being contained in an amount of at least 0.10 parts by mass relative to 100 parts by mass of the toner cores 11, the toner particles can be positively charged more efficiently, and thus the toner can have further improved charge stability. Besides, it is possible to easily achieve a coverage by the shell layers 13 of at least 60%, and thus the toner can have further improved non-adhering properties. As a result of the first resin particles 15 being contained in an amount of no greater than 1.50 parts by mass relative to 100 parts by mass of the toner cores 11, it is possible to easily achieve a coverage by the shell layers 13 of no greater than 80%, and thus the toner can have further improved low-temperature fixability.

The toner particles 10 may further have an external additive. The following describes another example of the toner particles included in the toner according to the present embodiment with reference to FIG. 3.

Second Example of Toner According to Present Embodiment

Figure 3:
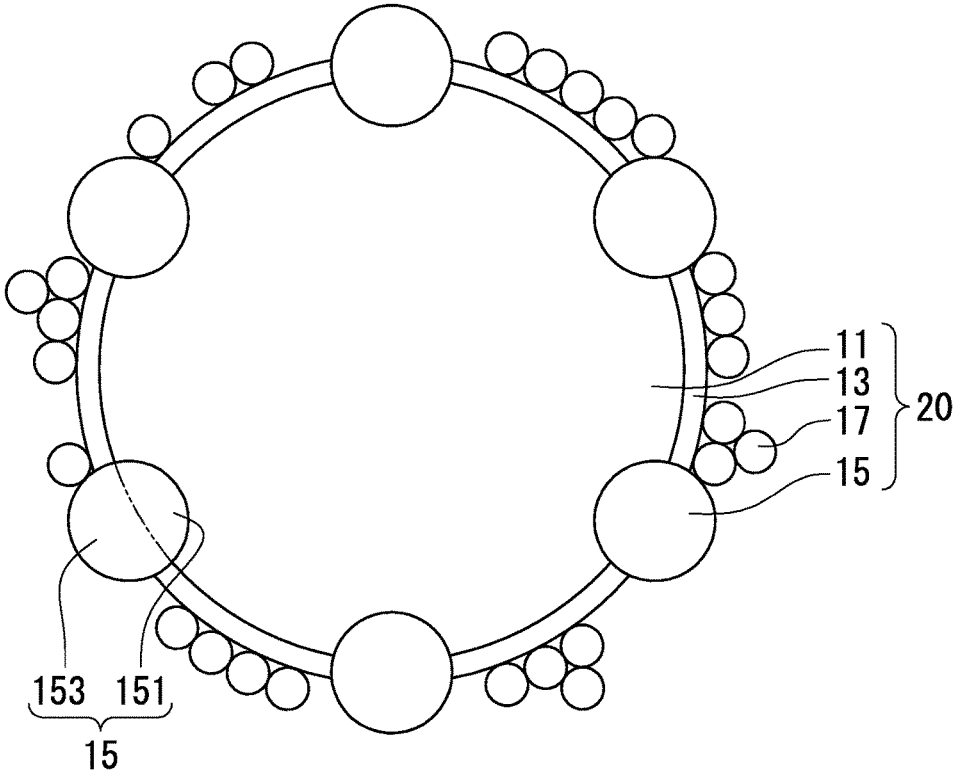
FIG. 3 is a cross-sectional view illustrating another example of the toner particles included in the toner according to the present disclosure.

FIG. 3 is a cross-sectional view illustrating another example of the toner particles included in the toner according to the present embodiment. The following description focuses on differences from the toner particle 10 illustrated in FIG. 1.

A toner particle 20 illustrated in FIG. 3 further has an external additive 17 adhering to the surface of the shell layer 13. As a result, the toner particle 20 is excellent in fluidity and handleability as well as in charge stability, non-adhering properties, and low-temperature fixability.

No particular limitations are placed on a material of external additive particles for forming the external additive 17. However, the external additive 17 preferably contains no external additive melamine particles. So long as the external additive 17 contains no external additive melamine particles, no external additive melamine particles detach from the toner particles 20, and thus triboelectric charging between the toner particles 20 and external additive melamine particles detached from the toner particles 20 does not occur. Consequently, the toner particles 20 are not negatively charged. Accordingly, the toner including the toner particles 20 has further improved charge stability. Through the above, the toner particles included in the toner according to the present embodiment have been described in detail with reference to FIGS. 1 to 3. The following describes a production method of the toner according to the present embodiment.

Production Method of Toner According to Present Embodiment

Preferably, the toner according to the present embodiment is produced in accordance with a method described below. For example, the production method of the toner including a plurality of the toner particles 10 illustrated in FIG. 1 preferably include a toner core formation process, a first resin particle embedding process, and a shell layer formation process. Preferably, the production method of the toner including a plurality of the toner particles 20 illustrated in FIG. 3 includes an external additive addition process in addition to the processes of the production method of the toner including a plurality of the toner particles 10 illustrated in FIG. 1. In order to produce the toner efficiently, a large number of toner particles are preferably formed at the same time. The toner particles produced at the same time are thought to have the same composition as one another. The following describes the preferable production method of the toner according to the present embodiment in order of the processes thereof.

(Toner Core Formation Process)

Preferably, in the toner core formation process, toner cores are formed by a known aggregation method or a known pulverization method. The known methods allow the toner cores to be formed easily.

(First Resin Particle Embedding Process)

In the first resin particle embedding process, portions of respective first resin particles are embedded in surfaces of the toner cores. Preferably, portions of the respective first resin particles are mechanically embedded in the surfaces of the toner cores. Examples of methods for mechanically embedding portions of the respective first resin particles in the surfaces of the toner cores include a method in which the toner cores and the first resin particles are mixed using a mixer (for example, "HYBRIDIZATION SYSTEM (registered Japanese trademark)"). Mixing of the toner cores and the first resin particles using the HYBRIDIZATION SYSTEM generates impact force of collision between the toner cores and the first resin particles. As a result, portions of the respective first resin particles are embedded in the surfaces of the toner cores easily.

Preferably, conditions for mixing of the toner cores and the first resin particles are set such that portions of the respective first resin particles are embedded in the surfaces of the toner cores. For example, a higher rotational speed in the HYBRIDIZATION SYSTEM facilitates generation of impact force of collision between the toner cores and the first resin particles. As a result, portions of the respective first resin particles are embedded in the surfaces of the toner cores easily. Consequently, $0.2 \leq Dp/Pd$ (see relation (1)) is easily satisfied, and relation (2) is easily satisfied. The same effect is produced by a longer time of mixing using the HYBRIDIZATION SYSTEM.

A lower rotational speed in the HYBRIDIZATION SYSTEM restricts impact force of collision between the toner cores and the first resin particles to a smaller level than a specific level. As a result, the first resin particles can be prevented from being entirely embedded in the toner cores. Thus, $Dp/Pd \leq 0.8$ (see relation (1)) is easily satisfied. The same effect is produced by a shorter time of mixing using the HYBRIDIZATION SYSTEM.

The rotational speed in the HYBRIDIZATION SYSTEM and the time of mixing using the HYBRIDIZATION SYSTEM each depend on the number average value Pd of the primary particle diameters d of the first resin particles or on the material of the toner cores. For example, the rotational speed in the HYBRIDIZATION SYSTEM is preferably at least 2,000 rpm and no greater than 10,000 rpm. For example, the time of mixing using the HYBRIDIZATION SYSTEM is preferably at least 5 minutes and no greater than 30 minutes.

As the first resin particles, particles whose number average value Pd of the primary particle diameters d satisfies relation (3) are prepared. Furthermore, as the first resin particles, particles containing a melamine resin are prepared. Preferably particles composed of a melamine resin are prepared. Preferably, the first resin particles are added in an amount of at least 0.10 parts by mass and no greater than 1.50 parts by mass relative to 100 parts by mass of the toner cores.

(Shell Layer Formation Process)

The shell layer formation process involves forming the shell layers on the surfaces of the toner cores with portions of the respective first resin particles embedded therein. For example, the shell layers are formed according to an in-situ polymerization process, an in-liquid curing film coating process, or a coacervation process. Through the above, the toner mother particles are obtained. In a situation in which the external additive addition process described below is not performed, the thus obtained toner mother particles are equivalent to the toner particles. Thus, the toner including a plurality of the toner particles 10 illustrated in FIG. 1 is obtained.

A desired shell layer coverage and a desired average value Wd of the shell layer thicknesses b can be achieved by adjusting the amount of the material for forming the shell layers (a shell layer material) that is supplied for the shell layer formation.

(External Additive Addition Process)

In the external additive addition process, an external additive is caused to adhere to surfaces of the shell layers. For example, the toner mother particles and the external additive are preferably mixed using a mixer (for example, an FM mixer or NAUTA MIXER (registered Japanese trademark)). Preferably, conditions for mixing the toner mother particles and the external additive are selected so as to prevent the external additive from being embedded in the surfaces of the shell layers. Preferably, external additive melamine particles are not used as the external additive particles. Thus, the toner including a plurality of the toner particles 20 illustrated in FIG. 3 is obtained.

Examples of Materials of First Resin Particles, Toner Cores, Shell Layers, and External Additive Particles

First Resin Particles

The first resin particles contain a melamine resin. Preferably, the first resin particles are composed of a melamine resin.

(Melamine Resin)

The melamine resin can be obtained through polycondensation of melamine and formaldehyde. The melamine resin has a three-dimensional network. More specifically, an addition reaction of melamine and formaldehyde is carried out. The addition reaction yields methylol melamine (a precursor of the melamine resin). Next, a condensation reaction between molecules of methylol melamine is carried out. Through the condensation reaction, amino groups on different methylol melamine molecules bond to one another via methylene groups. The above process yields the melamine resin. The thus obtained melamine resin includes a repeating unit derived from melamine.

The methylol melamine can be altered in terms of its solubility in water by changing the type or number of functional groups of the methylol melamine. Polymerization of methylol melamine in an aqueous medium is therefore caused relatively easily.

<Toner Cores>

The toner cores contain a binder resin. The toner cores may further contain at least one of a colorant, a releasing agent, a charge control agent, and a magnetic powder.

(Binder Resin)

The binder resin is typically a main component (for example, at least 85% by mass) of the toner cores. Properties of the binder resin are therefore expected to have great influence on an overall property of the toner cores.

Properties (specific examples include a hydroxyl value, an acid value, a glass transition point, and a softening point) of the binder resin can be adjusted by using a combination of a plurality of resins as the binder resin. The toner cores have a higher tendency to be anionic in a situation in which the binder resin has, for example, an ester group, a hydroxyl group, an ether group, an acid group, or a methyl group. The toner cores have a higher tendency to be cationic in a situation in which the binder resin has, for example, an amino group or an amide group. In order that the binder resin is strongly anionic, at least one of the hydroxyl value and the acid value of the binder resin is preferably at least 10 mgKOH/g.

Preferably, the toner cores contain a thermoplastic resin. Examples of thermoplastic resins that can be used include polyester resins, styrene-based resins, acrylic acid-based resins, olefin-based resins, vinyl resins, polyamide resins, and urethane resins. Examples of acrylic acid-based resins that can be used include polymers of acrylic acid esters and polymers of methacrylic acid esters. Examples of olefin-based resins that can be used include polyethylene resins and polypropylene resins. Examples of vinyl resins that can be used include vinyl chloride resins, polyvinyl alcohol, vinyl ether resins, and N-vinyl resins. A copolymer of any of the resins listed above, which in other words is a copolymer obtained by introducing a repeating unit into any of the resins listed above, may be used as a thermoplastic resin for forming the toner particles. For example, a styrene-acrylic acid-based resin or a styrene-butadiene-based resin may be used as a thermoplastic resin for forming the toner cores. The following describes a polyester resin, which is an example of the binder resin, in detail.

The polyester resin can be synthesized through polycondensation of at least one alcohol with at least one carboxylic acid. Examples of alcohols that can be used for synthesis of the polyester resin include di-, tri-, or higher-hydric alcohols listed below. Examples of di-hydric alcohols that can be used include diols and bisphenols. Examples of carboxylic acids that can be used for synthesis of the polyester resin include di-, tri-, or higher-basic carboxylic acids listed below.

Examples of diols that can be used include ethylene glycol, diethylene glycol, triethylene glycol, 1,2-propanediol, 1,3-propanediol, 1,4-butanediol, neopentyl glycol, 2-butene-1,4-diol, 1,5-pentanediol, 1,6-hexanediol, 1,4-cyclohexanedimethanol, dipropylene glycol, polyethylene glycol, polypropylene glycol, and polytetramethylene glycol.

Examples of bisphenols that can be used include bisphenol A, hydrogenated bisphenol A, bisphenol A ethylene oxide adduct, and bisphenol A propylene oxide adduct.

Examples of tri- or higher-hydric alcohols that can be used sorbitol, 1,2,3,6-hexanetetrol, 1,4-sorbitan, pentaerythritol, dipentaerythritol, tripentaerythritol, 1,2,4-butanetriol, 1,2,5-pentanetriol, glycerol, diglycerol, 2-methylpropanetriol, 2-methyl-1,2,4-butanetriol, trimethylolethane, trimethylolpropane, and 1,3,5-trihydroxymethylbenzene.

Examples of di-basic carboxylic acids that can be used include maleic acid, fumaric acid, citraconic acid, itaconic acid, glutaconic acid, phthalic acid, isophthalic acid, terephthalic acid, cyclohexanedicarboxylic acid, adipic acid, sebacic acid, azelaic acid, malonic acid, succinic acid, alkyl succinic acids (specific examples include n-butylsuccinic acid, isobutylsuccinic acid, n-octylsuccinic acid, n-dodecylsuccinic acid, and isododecylsuccinic acid), and alkenyl succinic acids (specific example include n-butenylsuccinic acid, isobutenylsuccinic acid, n-octenylsuccinic acid, n-dodecenylsuccinic acid, and isododecenylsuccinic acid).

Examples of tri- or higher-basic carboxylic acids that can be used include 1,2,4-benzenetricarboxylic acid (trimellitic acid), 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxyl-2-methyl-2-methylenecarboxypropane, 1,2,4-cyclohexanetricarboxylic acid, tetra(methylenecarboxyl)methane, 1,2,7,8-octanetetracarboxylic acid, pyromellitic acid, and EMPOL trimer acid.

(Colorant)

A known pigment or dye that matches the color of the toner can be used as the colorant. In order to form an image of high quality using the toner, the amount of the colorant is preferably at least 1 part by mass and no greater than 20 parts by mass relative to 100 parts by mass of the binder resin.

The toner cores may contain a black colorant. An example of the black colorant is carbon black. Alternatively, a colorant that is adjusted to a black color using a yellow colorant, a magenta colorant, and a cyan colorant can be used as a black colorant.

The toner cores may include a non-black colorant such as a yellow colorant, a magenta colorant, or a cyan colorant.

The yellow colorant that can be used is for example at least one compound selected from the group consisting of condensed azo compounds, isoindolinone compounds, anthraquinone compounds, azo metal complexes, methine compounds, and arylamide compounds. Examples of yellow colorants that can be used include C.I. Pigment Yellow (3, 12, 13, 14, 15, 17, 62, 74, 83, 93, 94, 95, 97, 109, 110, 111, 120, 127, 128, 129, 147, 151, 154, 155, 168, 174, 175, 176, 180, 181, 191, or 194), Naphthol Yellow S, Hansa Yellow G, and C.I. Vat Yellow.

The magenta colorant that can be used is for example at least one compound selected from the group consisting of condensed azo compounds, diketopyrrolopyrrole compounds, anthraquinone compounds, quinacridone compounds, basic dye lake compounds, naphthol compounds, benzimidazolone compounds, thioindigo compounds, and perylene compounds. Examples of magenta colorants that can be used include C.I. Pigment Red (2, 3, 5, 6, 7, 19, 23, 48:2, 48:3, 48:4, 57:1, 81:1, 122, 144, 146, 150, 166, 169, 177, 184, 185, 202, 206, 220, 221, or 254).

The cyan colorant that can be used is for example at least one compound selected from the group consisting of copper phthalocyanine compounds, anthraquinone compounds, and basic dye lake compounds. Examples of cyan colorants that can be used include C.I. Pigment Blue (1, 7, 15, 15:1, 15:2, 15:3, 15:4, 60, 62, or 66), Phthalocyanine Blue, C.I. Vat Blue, and C.I. Acid Blue.

(Releasing Agent)

The releasing agent is for example used in order to improve fixability or offset resistance of the toner. In order to increase the anionic strength of the toner cores, the toner cores are preferably prepared using an anionic wax. In order to improve fixability or offset resistance of the toner, the amount of the releasing agent is preferably at least 1 part by mass and no greater than 30 parts by mass relative to 100 parts by mass of the binder resin.

Examples of releasing agents that can be used include: aliphatic hydrocarbon waxes such as low molecular weight polyethylene, low molecular weight polypropylene, polyolefin copolymer, polyolefin wax, microcrystalline wax, paraffin wax, and Fischer-Tropsch wax; oxides of aliphatic hydrocarbon waxes such as polyethylene oxide wax and block copolymer of polyethylene oxide wax; plant waxes such as candelilla wax, carnauba wax, Japan wax, jojoba wax, and rice wax; animal waxes such as beeswax, lanolin, and spermaceti; mineral waxes such as ozokerite, ceresin, and petrolatum; waxes having a fatty acid ester as a main component such as montanic acid ester wax and castor wax; and waxes in which a fatty acid ester is partially or fully deoxidized such as deoxidized carnauba wax. One releasing agent may be used independently, or two or more releasing agents may be used in combination.

In order to improve compatibility between the binder resin and the releasing agent, a compatibilizer may be added to the toner cores.

(Charge Control Agent)

The charge control agent is for example used in order to improve charge stability or a charge rise characteristic of the toner. The charge rise characteristic of the toner is an indicator as to whether the toner can be charged to a specific charge level in a short period of time.

The anionic strength of the toner cores can be increased by including a negatively chargeable charge control agent in the toner cores. The cationic strength of the toner cores can be increased by including a positively chargeable charge control agent in the toner cores. However, when it is ensured that the toner has sufficient chargeability, the toner cores do not need to contain a charge control agent.

(Magnetic Powder)

Examples of materials of the magnetic powder that can be used include ferromagnetic metals or alloys thereof, ferromagnetic metal oxides, and materials subjected to ferromagnetization. Examples of ferromagnetic metals that can be used include iron, cobalt, and nickel. Examples of ferromagnetic metal oxides that can be used include ferrite, magnetite, and chromium dioxide. The ferromagnetization is for example carried out through thermal treatment. One magnetic powder may be used independently, or two or more magnetic powders may be used in combination.

The magnetic powder is preferably subjected to surface treatment in order to inhibit elution of metal ions (for example, iron ions) from the magnetic powder. In a situation in which the shell layers are formed on the surfaces of the toner cores under acidic conditions, elution of metal ions to the surfaces of the toner cores causes the toner cores to adhere to one another more readily. It is thought that inhibiting elution of metal ions from the magnetic powder thereby inhibits the toner cores from adhering to one another.

<Shell Layer>

The shell layers preferably contain a melamine resin. The melamine resin is as described in the section of (Melamine Resin) above.

The shell layers may further contain a thermosetting resin that is different from the melamine resin. The thermosetting resin that is different from the melamine resin is for example an aminoaldehyde resin (other than the melamine resin), a polyimide resin, or a xylene-based resin. An aminoaldehyde resin is a resin generated through polycondensation of an aldehyde and a compound having an amino group. Formaldehyde is for example used as the aldehyde. Examples of aminoaldehyde resins that can be used include urea-based resins, sulfonamide-based resins, glyoxal-based resins, guanamine-based resin, and aniline-based resins as well as melamine resins. Examples of polyimide resins that can be used include maleimide polymers and bismaleimide polymers.

The shell layers may further contain a thermoplastic resin. Examples of thermoplastic resins that can be used include thermoplastic resins listed in the section of (Binder Resin) above.

<External Additive Particles>

An external additive including a plurality of external additive particles is for example used in order to improve fluidity of the toner particles or handleability of the toner. Preferably, the amount of the external additive is for example at least 0.5 parts by mass and no greater than 10.0 parts by mass relative to 100 parts by mass of the toner mother particles. Preferably, the external additive particles have a particle diameter of at least 0.01 μm and no greater than 1.00 μm.

As the external additive particles, silica particles or particles of a metal oxide can be preferably used. Preferably, the metal oxide is for example alumina, titanium oxide, magnesium oxide, zinc oxide, strontium titanate, or barium titanate. One external additive may be used independently, or two or more external additives may be used in combination.

EXAMPLES

The following describes Examples of the present disclosure. Table 1 shows toners T-1 to T-14 according to Examples and Comparative Examples. In Table 1, "Wd" refers to an average value of the shell layer thicknesses b. "Composite particles" refer to particles including the toner cores and particles Y (the first resin particles 15) on the surfaces of the toner cores. "Melamine" shown as a material of the particles Y refers to a melamine resin. "Pd" refers to the number average value of the primary particle diameters d of the particles Y. "Dp" refers to the number average value of the embedment depths c of the particles Y. "Dp/Pd=0.00" indicates that the particles Y are not embedded in the surfaces of the toner cores at all. "Dp/Pd=1.0" indicates that the particles Y are entirely embedded in the toner cores. The column under the heading "relation (2)" shows whether or not (Pd−Dp)>Wd is satisfied.

TABLE 1

| Toner | | | | | | | | | |
|---|---|---|---|---|---|---|---|---|---|
| | | | Composite particles | | | | | | |
| | Shell layer | | | Particles Y | | | | | Fusing |
| Type | Wd (nm) | Coverage (%) | Type | Material | Pd (μm) | Dp (μm) | Dp/Pd | Relation (2) | temp. (° C.) |
| T-1 | 10 | 66 | TA-1 | Melamine | 0.10 | 0.080 | 0.80 | Satisfied | 105 |
| T-2 | 15 | 78 | TA-1 | | 0.10 | 0.080 | 0.80 | Satisfied | 110 |
| T-3 | 10 | 66 | TA-2 | | 0.20 | 0.080 | 0.40 | Satisfied | 105 |
| T-4 | 10 | 64 | TA-3 | | 0.40 | 0.100 | 0.25 | Satisfied | 105 |
| T-5 | 10 | 60 | TA-4 | | 1.00 | 0.200 | 0.20 | Satisfied | 105 |
| T-6 | 40 | 69 | TA-2 | | 0.20 | 0.080 | 0.40 | Satisfied | 102 |
| T-7 | 0 | 0 | TA-1 | Melamine | 0.10 | 0.080 | 0.80 | Satisfied | 94 |
| T-8 | 5 | 41 | TA-1 | | 0.10 | 0.080 | 0.80 | Satisfied | 98 |
| T-9 | 20 | 99 | TA-1 | | 0.10 | 0.080 | 0.80 | Not Satisfied | 118 |

TABLE 1-continued

| Toner | | | | | | | | | |
|---|---|---|---|---|---|---|---|---|---|
| | | | Composite particles | | | | | | |
| | Shell layer | | | Particles Y | | | | | Fusing |
| Type | Wd (nm) | Coverage (%) | Type | Material | Pd (μm) | Dp (μm) | Dp/Pd | Relation (2) | temp. (° C.) |
| T-10 | 10 | 66 | TA-5 | | 1.20 | 0.240 | 0.20 | Satisfied | 105 |
| T-11 | 10 | 65 | TA-6 | Silica | 0.10 | 0.080 | 0.80 | Satisfied | 103 |
| T-12 | 10 | 62 | TA-7 | Melamine | 0.10 | 0.000 | 0.00 | Satisfied | 105 |
| T-13 | 10 | 68 | TA-8 | | 0.10 | 0.100 | 1.00 | Not Satisfied | 105 |
| T-14 | 10 | 68 | TA-9 | Melamine | 0.05 | 0.010 | 0.20 | Satisfied | 105 |

The following first describes a preparation method of composite particles TA-1 to TA-9. The following then describes, in order, production methods, physical properties measurement methods, evaluation methods, and evaluation results of the toners T-1 to T-14. In evaluations in which errors might occur, an evaluation value was calculated by calculating an arithmetic mean of an appropriate number of measured values in order to ensure that any errors were sufficiently small.

[Preparation Method of Composite Particles]

(Preparation Method of Composite Particles TA-1)

First, a polyester resin was synthesized. More specifically, 1500.0 parts by mass of terephthalic acid, 1500.0 parts by mass of isophthalic acid, 1200.0 parts by mass of bisphenol A ethylene oxide adduct, and 800.0 parts by mass of ethylene glycol were added into a four-necked flask (capacity: 5 L). Next, a nitrogen atmosphere was maintained in the flask, and the internal temperature of the flask was raised up to 250° C. while the flask contents were stirred. The internal pressure of the flask was maintained at standard pressure and the internal temperature of the flask was maintained at 250° C. for 4 hours. During the period, the flask contents reacted.

Into the flask, 0.8 parts by mass of antimony trioxide, 0.5 parts by mass of triphenyl phosphate, and 0.1 parts by mass of tetrabutyl titanate were added. The internal pressure of the flask was reduced to 0.3 mmHg and the internal temperature of the flask was raised up to 280° C. The internal pressure of the flask was maintained at 0.3 mmHg and the internal temperature of the flask was maintained at 280° C. for 6 hours. During this period, the flask contents reacted.

Into the flask, 30.0 parts by mass of trimellitic acid (a cross-linking agent) was further added. The internal pressure of the flask was returned to standard pressure and the internal temperature of the flask was reduced to 230° C. The internal pressure of the flask was maintained at standard pressure and the internal temperature of the flask was maintained at 230° C. for 1 hour. During this period, the flask contents reacted. Next, the flask contents (a reaction product) was taken out of the flask and cooled. Through the above, the polyester resin was obtained. The thus obtained polyester resin had a glass transition point (Tg) of 53.8° C., a softening point (Tm) of 100.5° C., a number average molecular weight (Mn) of 1,460, a molecular weight distribution (Mw/Mn) of 12.7, an acid value of 16.8 mgKOH/g, and a hydroxyl value of 22.8 mgKOH/g.

Next, toner cores were prepared using the polyester resin. More specifically, an FM mixer ("FM-20B", product of Nippon Coke & Engineering Co., Ltd) was used to mix 90.0 parts by mass of the polyester resin particles, 5.0 parts by mass of carbon black ("MA100", product of Mitsubishi Chemical Corporation), and 5.0 parts by mass of carnauba wax ("Special Refined Carnauba Wax (Tokusei) No. 1", product of S. Kato & Co.) at a rotational speed of 2,400 rpm for 180 seconds. The resultant mixture was melt-kneaded using a twin screw extruder ("PCM-30", product of Ikegai Corp.) under conditions of a material feeding speed of 5 kg/hour, a shaft rotation speed of 150 rpm, and a temperature (cylinder temperature) of 150° C. The resultant melt-kneaded product was cooled, coarsely pulverized using a pulverizer ("Rotoplex 16/8", product of former TOA MACHINERY MFG. CO., LTD.), and then finely pulverized using an impact plate jet pulverizer ("Model-I Super Sonic Jet Mill", product of Nippon Pneumatic Mfg. Co., Ltd.). The finely pulverized product was classified using a classifier ("Elbow Jet EJ-LABO", product of Nittetsu Mining Co., Ltd.). Through the above, toner cores having a volume median diameter ($D_{50}$) of 8.0 μm were obtained.

Next, melamine resin particles were embedded in the surfaces of the toner cores. More specifically, an FM mixer ("FM-20B", product of Nippon Coke & Engineering Co., Ltd) was used to mix 100.0 parts by mass of the toner cores (the toner cores obtained as described above) and 1.0 part by mass of melamine resin particles ("EPOSTAR (registered Japanese trademark) SS", product of Nippon Shokubai Co., Ltd.) at a rotational speed of 800 rpm for 5 minutes. The resultant mixture was loaded into HYBRIDIZATION SYSTEM ("NHS—O", product of Nara Machinery Co., Ltd.) and mixed at a rotational speed of 5,000 rpm for 5 minutes. As a result, portions of the respective melamine resin particles were embedded in the surfaces of the toner cores. The resultant particles were sifted using a 200-mesh sieve (opening 75 μm). Particles that passed through the sieve were taken to be composite particles TA-1. Through the above, a powder including the composite particles TA-1 was obtained.

(Preparation Method of Composite Particles TA-2)

The composite particles TA-2 were prepared according to the same method as the preparation method of the composite particles TA-1 in all aspects other than that a different type of melamine resin particles ("EPOSTAR S", product of Nippon Shokubai Co., Ltd.) were used.

(Preparation Method of Composite Particles TA-3)

The composite particles TA-3 were prepared according to the same method as the preparation method of the composite particles TA-1 in all aspects other than that a different type of melamine resin particles ("EPOSTAR S6", product of Nippon Shokubai Co., Ltd.) were used.

(Preparation Method of Composite Particles TA-4)

The composite particles TA-4 were prepared according to the same method as the preparation method of the composite particles TA-1 in all aspects other than that a different type of melamine resin particles ("EPOSTAR S10", product of Nippon Shokubai Co., Ltd.) were used.

(Preparation Method of Composite Particles TA-5)

The composite particles TA-5 were prepared according to the same method as the preparation method of the composite particles TA-1 in all aspects other than that a different type of melamine resin particles ("EPOSTAR S12", product of Nippon Shokubai Co., Ltd.) were used.

(Preparation Method of Composite Particles TA-6)

The composite particles TA-6 were prepared according to the same method as the preparation method of the composite particles TA-1 in all aspects other than that silica particles ("SEAHOSTAR (registered Japanese trademark) KE-S10", product of Nippon Shokubai Co., Ltd.) were used instead of the melamine resin particles.

(Preparation Method of Composite Particles TA-7)

The composite particles TA-7 were prepared according to the same method as the preparation method of the composite particles TA-1 in all aspects other than that the mixing using the HYBRIDIZATION SYSTEM was not performed.

(Preparation Method of Composite Particles TA-8)

The composite particles TA-8 were prepared according to the same method as the preparation method of the composite particles TA-1 in all aspects other than that the mixing using the HYBRIDIZATION SYSTEM was performed for 10 minutes.

(Preparation Method of Composite Particles TA-9)

The composite particles TA-9 were prepared according to the same method as the preparation method of the composite particles TA-1 in all aspects other than that a different type of melamine resin particles (the number average value Pd of the primary particle diameters d was 0.050 μm) were used and the mixing using the HYBRIDIZATION SYSTEM was performed at a rotational speed of 2,000 rpm.

Each of the different types of melamine resin particles that were used in the preparation of the composite particles TA-1 to TA-5, TA-7 and TA-8 had a sharp particle size distribution. More specifically, the "EPOSTAR SS" produced by Nippon Shokubai Co., Ltd., the "EPOSTAR S" produced by Nippon Shokubai Co., Ltd., the "EPOSTAR S6" produced by Nippon Shokubai Co., Ltd., the "EPOSTAR S10" produced by Nippon Shokubai Co., Ltd., and the "EPOSTAR S12" produced by Nippon Shokubai Co., Ltd. included substantially only melamine resin particles having a particle diameter of approximately 0.1 μm, a particle diameter of approximately 0.2 μm, a particle diameter of approximately 0.4 μm, a particle diameter of approximately 1.0 μm, and a particle diameter of approximately 1.2 μm, respectively. The melamine resin particles that were used in the preparation of the composite particles TA-9 had a sharp particle size distribution and included substantially only melamine resin particles having a particle diameter of approximately 0.05 μm.

The silica particles that were used in the preparation of the composite particles TA-6 had a sharp particle size distribution. More specifically, the "SEAHOSTAR KE-S10" produced by Nippon Shokubai Co., Ltd. included substantially only silica particles having a particle diameter of approximately 0.1 μm.

[Toner Production Method]

(Production Method of Toner T-1)

First, shell layers were formed on the surfaces of the composite particles TA-1. More specifically, 300.0 mL of ion exchanged water was added into a three-necked flask (capacity: 1 L) having a thermometer and a stirring impeller. A water bath ("IWB-250" sold by AS ONE Corporation) was used to maintain the internal temperature of the flask at 30° C. The liquid in the flask was adjusted to pH 4 through addition of dilute hydrochloric acid to the flask. Furthermore, 1.0 mL of an aqueous methylol melamine solution ("MIRBANE (registered Japanese trademark) Resin SM-607", product of Showa Denko K.K.) and 1.0 mL of an aqueous polyacrylamide solution (product of Wako Pure Chemical Industries, Ltd., polyacrylamide concentration: 10% by mass) were added into the flask. The flask contents were stirred to give an aqueous shell layer material solution S-1.

To the thus obtained aqueous solution S-1, 300 g of the composite particles TA-1 were added. The flask contents were stirred at a rotational speed of 200 rpm for 1 hour. Furthermore, 500.0 mL of ion exchanged water and 3.0 mL of an aqueous sodium p-toluenesulfonate solution (product of Tokyo Chemical Industry Co., Ltd.) were added into the flask. The internal temperature of the flask was raised up to 70° C. at a rate of 1° C./minute while the flask contents were stirred at a rotational speed of 100 rpm. The flask contents were stirred at a rotational speed of 100 rpm for 2 hours while the internal temperature of the flask was maintained at 70° C. The flask contents were adjusted to pH 7 through addition of sodium hydroxide to the flask. Next, the flask contents were cooled to room temperature. As a result, a shell layer (a layer of a melamine resin) was formed on the surface of each of the composite particles TA-1. Through the above, a dispersion containing toner mother particles was obtained.

Next, the toner mother particles were washed. More specifically, a wet cake of the toner mother particles was collected through filtration of the toner mother particle-containing dispersion using a Buchner funnel. The wet cake of the toner mother particles was dispersed in ion exchanged water. Through the above, the toner mother particles were washed. The same washing of the toner mother particles using ion exchanged water was repeated five times.

Next, the wet cake of the toner mother particles was dried. More specifically, a slurry was prepared by dispersing the wet cake of the toner mother particles in an aqueous ethanol solution (concentration 50% by mass). The resultant slurry was supplied into a continuous type surface modifier (COATMIZER (registered Japanese trademark), product of Freund Corporation) to dry the toner mother particles in the slurry. The drying using COATMIZER was carried out under conditions of a hot air temperature of 45° C. and a blower flow rate of 2 $m^3$/minute. Through the above, the toner mother particles were obtained.

Next, external additive addition was performed. More specifically, an FM mixer ("FM-10B", product of Nippon Coke & Engineering Co., Ltd., capacity: 10 L) was used to mix 100.0 parts by mass of the toner mother particles and 0.5 parts by mass of positively chargeable silica particles ("AEROSIL (registered Japanese trademark) REA90", product of Nippon Aerosil Co., Ltd.) for 5 minutes. As a result, the external additive was caused to adhere to the surfaces of the toner mother particles. The resultant particles were sifted using a 200-mesh sieve. Through the above, a toner including a plurality of toner particles (the toner T-1) was obtained.

(Production Method of Toner T-2)

The toner T-2 was obtained according to the same method as the production method of the toner T-1 in all aspects other than the following. That is, 2.0 mL of the aqueous methylol melamine solution and 2.0 mL of the aqueous polyacrylamide solution were added to the three-necked flask to give an aqueous shell layer material solution.

(Production Method of Toners T-3 to T-5)

The toners T-3 to T-5 were respectively obtained according to the same method as the production method of the toner T-1 in all aspects other than that the composite particles TA-2 to TA-4 were used instead of the composite particles TA-1.

(Production Method of Toner T-6)

The toner T-6 was obtained according to the same method as the production method of the toner T-3 in all aspects other than the following. That is, 5.0 mL of an aqueous solution of methylol urea ("MX-280", product of Nippon Carbide Industries Co., Inc.) was added into the three-necked flask instead of the aqueous methylol melamine solution to give an aqueous shell layer material solution.

(Production Method of Toner T-7)

The toner T-7 was obtained according to the same method as the production method of the toner T-1 in all aspects other than that no shell layers were formed. More specifically, an FM mixer ("FM-10B", product of Nippon Coke & Engineering Co., Ltd., capacity: 10 L) was used to mix 100.0 parts by mass of the composite particles TA-1 and 0.5 parts by mass of positively chargeable silica particles ("AEROSIL REA90", product of Nippon Aerosil Co., Ltd.) for 5 minutes. Through the above, the external additive was caused to adhere to the surfaces of the composite particles TA-1. The resultant particles were sifted using a 200-mesh sieve. Through the above, a toner including a plurality of toner particles (the toner T-7) was obtained.

(Production Method of Toner T-8)

The toner T-8 was obtained according to the same method as the production method of the toner T-1 in all aspects other than the following. That is, 0.5 mL of the aqueous methylol melamine solution and 0.5 mL of the aqueous polyacrylamide solution were added to the three-necked flask to give an aqueous shell layer material solution.

(Production Method of Toner T-9)

The toner T-9 was obtained according to the same method as the production method of the toner T-1 in all aspects other than the following. That is, 4.0 mL of the aqueous methylol melamine solution and 4.0 mL of the aqueous polyacrylamide solution were added to the three-necked flask to give an aqueous shell layer material solution.

(Production Method of Toners T-10 to T-14)

The toners T-10 to T-14 were respectively obtained according to the same method as the production method of the toner T-1 in all aspects other than that the composite particles TA-5 to TA-9 were used instead of the composite particles TA-1.

[Measurement Methods of Toner Physical Properties]

The following describes measurement methods of the average value Wd of the shell layer thicknesses b, the shell layer coverage, the number average value Dp of the embedment depths c of the particles Y, and the fusing temperature of the toner. Note that the average value Wd of the shell layer thicknesses b, the shell layer coverage, and the number average value Dp of the embedment depths c of the particles Y were measured using, as a sample, the toner particles from which the external additive had been removed by a method (pretreatment) described below (that is, toner mother particles).

(Pretreatment)

The external additive was removed from the surfaces of the toner particles included in each of the toners T-1 to T-14 in accordance with a method described below. More specifically, 2 g of the toner was dispersed in 100 g of an aqueous solution (concentration 2% by mass) of a non-ionic surfactant ("EMULGEN (registered Japanese trademark) 120", product of Kao Corporation, ingredient: polyoxyethylene lauryl ether). The resultant dispersion was put in water bath and irradiated with ultrasound using an ultrasonic disperser ("Mini Ultrasonic Welder P128", product of Ultrasonic Engineering Co., Ltd., output: 100 W, oscillatory frequency: 28 kHz). The resultant suspension was filtered by suction using a separate-type suction and filtration device (a bell jar and a Buchner funnel) with qualitative filter paper ("FILTERPAPER No. 1", product of ADVANTEC, pore diameter approximately 5 μm) set therein. Thereafter, reslurring through addition of 50.0 mL of ion exchanged water and filtering by suction were repeated three times. Thus, the external additive was removed from the surfaces of the toner particles. Through the above, a measurement sample was obtained.

(Method for Measuring Average Value Wd of Shell Layer Thicknesses b)

First, TEM photographs of cross-sections of toner mother particles were captured. More specifically, the toner mother particles were dispersed in a cold-setting epoxy resin and left to stand for 2 days at an ambient temperature of 40° C. The resultant hardened material was dyed in osmium tetroxide. A flake sample (thickness 200 nm) was cut from the dyed hardened material using a microtome ("EM UC6", product of Leica Microsystems). The resultant flake sample was observed using a transmission electron microscope (TEM) ("JSM-6700F", product of JEOL Ltd.) at magnifications of ×3,000 and ×10,000, and TEM photographs of the cross-sections of the toner mother particles were captured.

Next, the TEM photographs of the cross-sections of the toner mother particles were analyzed using image analysis software ("WinROOF", product of Mitani Corporation). More specifically, two straight lines that intersected at right angles at substantially the center of the cross-section of a toner mother particle were drawn. On the two respective straight lines, lengths (four lengths) that were each from an interface between the toner core and the shell layer (equivalent to the surface of the toner core) to the surface of the shell layer were measured. An arithmetic mean of the thus measured four lengths was taken to be the thickness of the shell layer of the toner mother particle. Such shell layer thickness measurement was performed for ten toner mother particles to obtain an average value of shell layer thicknesses for the ten toner mother particles. The thus obtained average value was taken to be the average value Wd of the shell layer thicknesses b. Table 1 shows the results.

(Method for Measuring Shell Layer Coverage)

First, the toner mother particles were exposed to vapor of 2 mL of an aqueous $RuO_4$ solution (concentration 5% by mass) for 20 minutes under an air atmosphere at room temperature (25° C.). The toner mother particles dyed as described above were observed using an field effect scanning electron microscope (FE-SEM) ("JSM-7600F", product of JEOL Ltd.) to capture a backscattered electron image of a toner mother particle. Of the surface of the toner core, a region that was covered with the shell layer was dyed in ruthenium (Ru) more easily than a region that was not covered by the shell layer. Accordingly, in the resultant backscattered electron image, the region of the surface of the toner core that was covered by the shell layer appeared brighter than the region that was not covered by the shell layer. The observation using the field effect scanning electron microscope was carried out under conditions of an accelerating voltage of 10.0 kV and an irradiation current of approximately 95 pA. The image capture using the field effect scanning electron microscope was carried out under conditions of a magnification of ×50,000, a contrast of 4,800, and a brightness of 550.

Next, the backscattered electron image obtained as described above was analyzed using image analysis software ("WinROOF", product of Mitani Corporation). More specifically, 3×3 Gaussian blur was performed on the resultant backscattered electron image (a jpg image file). Next, brightness distribution of the shell layer in the backscattered electron image was measured using the image analysis software ("WinROOF", product of Mitani Corporation). Next, the area $S_{A1}$ of the entire backscattered electron image of the toner particle and the area $S_{B1}$ of a brighter region of the backscattered electron image were determined, and the shell layer coverage was calculated in accordance with the following formula. Table 1 shows the results.

$$\text{Shell layer coverage}=100\times\text{Area } S_m/\text{Area } S_{A1}$$

(Method for Measuring Number Average Value Dp of Embedment Depths c of Particles Y)

First, a TEM photograph of cross-sections of toner mother particles was captured. Next, the TEM photograph of the cross-section of the toner mother particle was analyzed using image analysis software ("WinROOF", product of Mitani Corporation). More specifically, a line length measurement function as a manual measurement function of a measurement tool was selected in the image analysis software. With the line length measurement function as the manual measurement function selected, several particles Y (melamine resin particles or silica particles) that were each partially embedded in the surface of a toner core were randomly selected in the TEM photograph of the cross-sections of the toner particles. Embedment depths of the respective selected particles Y were measured. Such measurement of the embedment depth of the particles Y was performed for ten toner mother particles to calculate the number average value Dp of the embedment depths c of the particles Y. Table 1 shows the results.

Note that the inventor of the present disclosure confirmed that the standard deviation of the embedment depths of the particles Y was relatively small. More specifically, with respect to the composite particles TA-1 to TA-6, TA-8, and TA-9, the standard deviation of the embedment depths of the particles Y was less than 0.01 times the number average value Dp of the embedment depths c of the particles Y shown in Table 1.

(Method for Measuring Fusing Temperature of Toner)

The fusing temperature of each of the toners T-1 to T-14 was measured in accordance with a method described below.

First, a cylindrical sample was prepared. More specifically, the toner was left to stand for over 12 hours under environmental conditions of 23° C.±1° C. and 50% RH±5% RH. As a result, the humidity of the toner was adjusted. Next, 2 g of the toner was pressed into a cylindrical shape at a pressure of 10 MPa using a pressure shaping machine. Thus, the cylindrical sample (a cylindrical sample having a circle of 1 cm in diameter as a bottom face) was obtained.

Next, the cylindrical sample was set in a capillary rheometer ("CFT-500D", product of Shimadzu Corporation), and then melt-flow of the sample was caused under environmental conditions of 23° C.±5° C. and 50% RH±10% RH. The melt-flow of the sample was caused under conditions of a die diameter of 1 mm, a die length of 10 mm, a plunger load of 294 N (30 kg/cm$^2$), a preheat time of 5 minutes, and a heating rate of 4°/minute. Thus, an S-shaped curve (horizontal axis: temperature, vertical axis: stroke) of the sample was plotted.

Next, the fusing temperature of the toner was read from the S-shaped curve. More specifically, the fusing temperature of the toner was a temperature (° C.) on the S-shaped curve corresponding to a stroke value of "$(S_1+S_2)/2$", where $S_1$ represents a maximum stroke value and $S_2$ represents a base line stroke value at low temperatures. Table 1 shows the results.

[Evaluation Methods]

Each of the toners T-1 to T-14 was evaluated in accordance with methods described below. A two-component developer produced according to the following method was used as an evaluation target in each of evaluations described below. More specifically, with respect to each of the toners T-1 to T-14, the toner and a Cu—Zn ferrite carrier (product of Powdertech Co., Ltd., volume resistivity: $10^7$ Ωcm, saturation magnetization: 70 emu/g, average particle diameter: 35 μm) were loaded into a ball mill to give a toner content of 10% by mass and mixed together for 30 minutes. Thus, the evaluation target was obtained. Surfaces of ferrite particles (carrier cores) in the Cu—Zn ferrite carrier each had a coat layer, and the coat layers were formed from a fluororesin in an amount of 20 parts by mass relative to 100 parts by mass of the ferrite particles.

(Evaluation of Low-Temperature Fixability of Toner)

Image formation was performed using the evaluation target to evaluate low-temperature fixability of the toner. A printer ("FS-C5250DN", product of KYOCERA Document Solutions Inc.) modified in order to enable adjustment of fixing temperature was used as an evaluation apparatus. More specifically, the evaluation target (unused) was loaded into a developing device of the evaluation apparatus, and a toner for replenishment use (unused) was loaded into a toner container of the evaluation apparatus. In the Examples, the same toner as the toner included in the evolution target was used as the toner for replenishment use.

Next, the evaluation apparatus was used to form a first sample image (unfixed image) on printing paper under conditions of a linear velocity of 200 mm/second and a toner load of 1.0 mg/cm$^2$. The thus formed first sample image was fixed to the printing paper. Fixing was performed in a fixing temperature range of from 100° C. to 200° C. by increasing the fixing temperature in increments of 5° C. As a result, 21 sheets of printing paper each having the first sample image fixed thereto were obtained.

Next, a fold-rubbing test was performed. More specifically, the printing paper was folded in half such that a surface to which the first sample image was fixed was folded inwards. The fold of the printing paper was rubbed back and forth five times with a 1 kg weight covered with cloth. Next, the printing paper was opened up and the length of toner peeling (hereinafter, referred to as peeling length) of a fold portion of the printing paper, more particularly a portion on which the first sample image was formed, was measured. The first sample image was determined to pass the evaluation if the peeling length was 1.0 mm or less. A lowest of the fixing temperatures that each resulted in the first sample image determined to pass was taken to be a minimum fixing temperature. Low-temperature fixability was evaluated as excellent if the minimum fixing temperature was not greater than 140° C. Low-temperature fixability was evaluated as good if the minimum fixing temperature was greater than 140° C. and not greater than 150° C. Low-temperature fixability was evaluated as poor if the minimum fixing temperature was greater than 150° C. Table 2 shows the results.

(Evaluation of Charge Stability of Toner)

Image formation was performed using the evaluation target to evaluate image density and fogging density. A multifunction peripheral ("TASKalfa 500ci", product of KYOCERA Document Solutions Inc.) was used as an evaluation apparatus. More specifically, the evaluation target (unused) was loaded into a developing device for a black color of the evaluation apparatus, and the toner for replenishment use (unused) was loaded into a toner container of the evaluation apparatus. In the Examples, the same toner as the toner included in the evolution target was used as the toner for replenishment use. A voltage difference (ΔV) between a magnet roll and a development sleeve in a development roller of the evaluation apparatus was set to 250 V, and an alternating current voltage (Vpp) was set to 2.0 kV to be applied to the magnet roll.

Next, a sample image having a coverage of 4% was formed on 1,000 successive sheets of printing paper, and a second sample image having a coverage of 100% was formed on printing paper under environmental conditions of 10° C. and 10% RH. An image density (ID) and a fogging density (FD) were measured using the second sample image. Such a series of operations was performed until the number of sheets on which the sample image having a coverage of 4% was printed reached 5,000. That is, every time the sample image having a coverage of 4% was printed on 1,000 successive sheets of printing paper, the image density (ID) and the fogging density (FD) were measured.

In the measurement of the image density (ID), a Macbeth reflection densitometer ("RD914", product of X-Rite Inc.) was used to measure a reflection density (ID: image density) of a solid image portion of the second sample image.

Charge stability was evaluated as excellent if the image density (ID) was at least 1.20 at the time when the number of sheets on which the sample image having a coverage of 4% was printed reached 5,000. Charge stability was evaluated as good if the image density (ID) was at least 1.20 at the time when the number of sheets on which the sample image having a coverage of 4% was printed reached 4,000 and the image density (ID) was at least 1.10 and less than 1.20 at the time when the number of sheets on which the sample image having a coverage of 4% was printed reached 5,000. Charge stability was evaluated as poor if the image density (ID) was less than 1.20 at the time when the number of sheets on which the sample image having a coverage of 4% was printed reached 4,000. Table 2 shows the results.

In the measurement of the fogging density (FD), a color reflectance densitometer ("R710", product of Ihara Electronic Industries Co., Ltd.) was used to measure a reflection density of a blank portion of the second sample image. Then, the fogging density (FD) was calculated in accordance with the following formula.

FD=(Reflection density of blank portion)−(Reflection density of unprinted sheet of paper)

Charge stability was evaluated as excellent if the fogging density (FD) was less than 0.010 at the time when the number of sheets on which the sample image having a coverage of 4% was printed reached 5,000. Charge stability was evaluated as good if the fogging density (FD) was less than 0.010 at the time when the number of sheets on which the sample image having a coverage of 4% was printed reached 4,000 and the fogging density (FD) was at least 0.010 at the time when the number of sheets on which the sample image having a coverage of 4% was printed reached 5,000. Charge stability was evaluated as poor if the fogging density (FD) was at least 0.010 at the time when the number of sheets on which the sample image having a coverage of 4% was printed reached 4,000. Table 3 shows the results.

(Evaluation of Non-Adhering Properties of Toner)

Image formation was performed using the evaluation target to evaluate presence or absence of spots and image void in a resultant image and presence or absence of toner adhering to the surface of a photosensitive drum. The same evaluation apparatus as that used in the evaluation of charge stability of the toner was used.

More specifically, a sample image having a coverage of 4% was printed on 5,000 successive sheets of printing paper under environmental conditions of 32.5° C. and 80% RH. Thereafter, a solid image having a coverage of 100% was printed on an entire sheet of A4 size printing paper, and then a halftone image having a coverage of 50% was printed on an entire sheet of A4 size printing paper. Presence or absence of spots and image void in the resultant solid image and the resultant halftone image was visually observed. Furthermore, presence or absence of a toner component adhering to the surface of the photosensitive drum was visually observed after the solid image and the halftone image had been formed. Table 3 shows the results.

Excellent: No spots and no image void were observed in the solid image and the halftone image, and no toner component adhering to the surface of the photosensitive drum was observed.

Good: No spots and no image void were observed in the solid image and the halftone image, but some toner component adhering to the surface of the photosensitive drum was observed.

Poor: Some spots and image void were observed in the solid image and the halftone image, and some toner component adhering to the surface of the photosensitive drum was observed.

TABLE 2

| | | Low-temperature fixability | | Charge stability (image density) | | |
|---|---|---|---|---|---|---|
| | Toner | Evaluation | Minimum fixing temp. (° C.) | Evaluation | 4000 sheets | 5000 sheets |
| Example 1 | T-1 | Excellent | 140 | Good | 1.24 | 1.18 |
| Example 2 | T-2 | Good | 145 | Good | 1.25 | 1.19 |
| Example 3 | T-3 | Excellent | 140 | Excellent | 1.24 | 1.24 |
| Example 4 | T-4 | Excellent | 140 | Excellent | 1.23 | 1.21 |
| Example 5 | T-5 | Good | 150 | Excellent | 1.24 | 1.22 |
| Example 6 | T-6 | Excellent | 140 | Excellent | 1.23 | 1.23 |

TABLE 2-continued

| | | Low-temperature fixability | | Charge stability (image density) | | |
|---|---|---|---|---|---|---|
| | Toner | Evaluation | Minimum fixing temp. (° C.) | Evaluation | 4000 sheets | 5000 sheets |
| Comparative Example 1 | T-7 | Excellent | 130 | Poor | 1.10 | 1.04 |
| Comparative Example 2 | T-8 | Excellent | 135 | Good | 1.23 | 1.18 |
| Comparative Example 3 | T-9 | Poor | 155 | Excellent | 1.21 | 1.23 |
| Comparative Example 4 | T-10 | Good | 150 | Poor | 0.98 | 0.80 |
| Comparative Example 5 | T-11 | Excellent | 140 | Good | 1.21 | 1.17 |
| Comparative Example 6 | T-12 | Excellent | 140 | Poor | 0.98 | 0.80 |
| Comparative Example 7 | T-13 | Excellent | 140 | Good | 1.23 | 1.18 |
| Comparative Example 8 | T-14 | Excellent | 140 | Good | 1.20 | 1.16 |

In Table 2, the heading "4000 sheets" indicates the image density (ID) at the time when the number of sheets on which the sample image having a coverage of 4% was printed reached 4,000. The heading "5000 sheets" indicates the image density (ID) at the time when the number of sheets on which the sample image having a coverage of 4% was printed reached 5,000.

TABLE 3

| | | Charge stability (fogging density) | | | |
|---|---|---|---|---|---|
| | Toner | Evaluation | 4000 sheets | 5000 sheets | Non-adhering properties |
| Example 1 | T-1 | Excellent | 0.0020 | 0.0030 | Good |
| Example 2 | T-2 | Excellent | 0.0030 | 0.0040 | Good |
| Example 3 | T-3 | Excellent | 0.0020 | 0.0040 | Excellent |
| Example 4 | T-4 | Excellent | 0.0030 | 0.0030 | Excellent |
| Example 5 | T-5 | Excellent | 0.0020 | 0.0030 | Excellent |
| Example 6 | T-6 | Excellent | 0.0040 | 0.0060 | Excellent |
| Comparative Example 1 | T-7 | Good | 0.0070 | 0.0150 | Poor |
| Comparative Example 2 | T-8 | Good | 0.0050 | 0.0100 | Poor |
| Comparative Example 3 | T-9 | Excellent | 0.0010 | 0.0020 | Excellent |
| Comparative Example 4 | T-10 | Good | 0.0090 | 0.0120 | Poor |
| Comparative Example 5 | T-11 | Poor | 0.0210 | 0.0360 | Excellent |
| Comparative Example 6 | T-12 | Poor | 0.0150 | 0.0300 | Poor |
| Comparative Example 7 | T-13 | Poor | 0.0150 | 0.0500 | Poor |
| Comparative Example 8 | T-14 | Good | 0.0060 | 0.0100 | Poor |

In Table 3, the heading "4000 sheets" indicates the fogging density (FD) at the time when the number of sheets on which the sample image having a coverage of 4% was printed reached 4,000. The heading "5000 sheets" indicates the fogging density (FD) at the time when the number of sheets on which the sample image having a coverage of 4% was printed reached 5,000.

The toners T-1 to T-6 (the toners according to Examples 1 to 6) were each a positively chargeable toner and each included toner particles having the above-described feature. More specifically, each of the toner particles had a toner core, a shell layer covering a surface of the toner core, and a plurality of first resin particles containing a melamine resin. The proportion of the area of a region, of the surface of the toner core, that was covered with the shell layer was at least 60% and no greater than 80%. Each of the first resin particles had an embedded portion and a protrusion portion. The embedded portions were embedded beneath the surface of the toner core. The protrusion portions protruded outward from the surface of the toner core in a radial direction of the toner particle. The average value Wd of the shell layer thicknesses b, the number average value Dp of the embedment depths c of the first resin particles, and the number average value Pd of the primary particle diameters d of the first resin particles satisfied relations (1) to (3) shown below.

$$0.2 \leq Dp/Pd \leq 0.8 \quad (1)$$

$$(Pd-Dp) > Wd \quad (2)$$

$$0.10\ \mu m \leq Pd \leq 1.00\ \mu m \quad (3)$$

As indicated in Tables 2 and 3, each of the toners T-1 to T-6 was excellent in low-temperature fixability, charge stability, and non-adhering properties.

The toner T-7 (the toner according to Comparative Example 1) had poor results in the evaluation of charge stability (image density) and the evaluation of non-adhering properties compared to the toners T-1 to T-6. It is thought that such results were obtained because the toner T-7 had no shell layers.

The toner T-8 (the toner according to Comparative Example 2) had a poor result in the evaluation of non-adhering properties compared to the toners T-1 to T-6. It is thought that such a result was obtained because the toner T-8 had a too small shell layer coverage.

The toner T-9 (the toner according to Comparative Example 3) had a poor result in the evaluation of low-temperature fixability compared to the toners T-1 to T-6. It is thought that such a result was obtained for the following reasons. That is, the toner T-9 had a too large shell layer coverage. Furthermore, relation (2) was not satisfied.

The toner T-10 (the toner according to Comparative Example 4) had poor results in the evaluation of charge stability (image density) and the evaluation of non-adhering properties compared to the toners T-1 to T-6. It is thought that such results were obtained for the following reasons. The number average value Pd of the primary particle diameters d of the particles Y was too large. Accordingly, charge stability and the non-adhering properties of the toner decreased even though relations (1) and (2) were satisfied.

The toner T-11 (the toner according to Comparative Example 5) had a poor result in the evaluation of charge stability (fogging density) compared to the toners T-1 to T-6. It is thought that such a result was obtained because negatively-chargeable silica particles were used as the particles Y.

The toner T-12 (the toner according to Comparative Example 6) had poor results in the evaluation of charge stability (image density and fogging density) and the evaluation of non-adhering properties compared to the toners T-1 to T-6. It is thought that such results were obtained because the particles Y were not embedded in the surfaces of the toner cores (Dp/Pd=0).

The toner T-13 (the toner according to Comparative Example 7) had poor results in the evaluation of charge stability (fogging density) and the evaluation of non-adhering properties compared to the toners T-1 to T-6. It is thought that such results were obtained because the particles Y were entirely embedded in the surfaces of the toner cores (Dp/Pd=1).

The toner T-14 (the toner according to Comparative Example 8) had a poor result in the evaluation of non-adhering properties compared to the toners T-1 to T-6. It is thought that such a result was obtained because the number average value Pd of the primary particle diameters d of the particles Y was too small.

What is claimed is:

1. A toner comprising a plurality of toner particles, the toner being positively chargeable, wherein each of the toner particles has a toner core, a shell layer covering a surface of the toner core, and a plurality of first resin particles containing a melamine resin, a proportion of an area of a region, of a surface of the toner core, that is covered with the shell layer is at least 60% and no greater than 80%, each of the first resin particles has an embedded portion and a protrusion portion, the embedded portions are embedded beneath the surface of the toner core, the protrusion portions protrude outward from the surface of the toner core in a radial direction of the toner particle, and an average value Wd of thicknesses b of the shell layers, a number average value Dp of embedment depths c of the first resin particles, and a number average value Pd of primary particle diameters d of the first resin particles satisfy relations (1) to (3) shown below, $$0.2 \leq Dp/Pd \leq 0.8 \quad (1)$$

$$(Pd-Dp) > Wd \quad (2)$$

$$0.10\ \mu m \leq Pd \leq 1.00\ \mu m \quad (3)$$

where in relation (1), the number average value Dp of the embedment depths c of the first resin particles refers to a number average value of lengths of the embedded portions in the radial direction of the toner particle.

2. The toner according to claim 1, wherein the toner has a fusing temperature of at least 80° C. and no greater than 110° C. as measured using a capillary rheometer.

3. The toner according to claim 1, wherein the average value Wd of the thicknesses b of the shell layers is at least 10 nm and no greater than 50 nm.

4. The toner according to claim 1, wherein the number average value Pd of the primary particle diameters d of the first resin particles is at least 0.20 μm and no greater than 1.00 μm.

5. The toner according to claim 1, wherein each of the shell layers covers the surface of the corresponding toner core such that the shell layer covers a region surrounding the first resin particles.

6. The toner according to claim 5, wherein each of the protrusion portions is covered with the shell layer in a portion thereof at a radially inner side of the toner particle.

7. The toner according to claim 1, wherein the shell layers contain a melamine resin.

8. The toner according to claim 1, wherein each of the toner particles further has an external additive, and the external additive does not include particles containing a melamine resin.

* * * * *